US005715613A

United States Patent [19]

Ebert

[11] Patent Number: 5,715,613

[45] Date of Patent: Feb. 10, 1998

[54] BACK PLOW BLADE CONSTRUCTION

[76] Inventor: Fred Ebert, 1250 Doblon St., Apt. C, Green Bay, Wis. 54302

[21] Appl. No.: 753,206

[22] Filed: Nov. 21, 1996

[51] Int. Cl.[6] ..... E01H 5/06

[52] U.S. Cl. ..... 37/266; 37/221; 37/285

[58] Field of Search ..... 37/206, 267, 270, 37/219, 220, 221, 278, 285, 903; 172/684.8; 294/54, 51, 59

[56] References Cited

U.S. PATENT DOCUMENTS

| | | | |
|---|---|---|---|
| 3,442,545 | 5/1969 | Ramon | 294/59 |
| 4,570,366 | 2/1986 | Yost | 37/270 X |
| 4,709,492 | 12/1987 | Watson | 37/270 X |
| 4,803,790 | 2/1989 | Ciula | 37/266 |
| 5,140,763 | 8/1992 | Nichols, IV | 37/233 |
| 5,456,028 | 10/1995 | Larson | 37/403 X |
| 5,611,157 | 3/1997 | Ferreira | 37/266 X |

*Primary Examiner*—Terry Lee Melius
*Assistant Examiner*—Thomas A. Beach

[57] ABSTRACT

The present invention relates to a blade which can be removably secured to the bottom of a conventional snow plow. The blade enables the operator of the snow plow to collect snow in either the forward or rearward running directions of the snow plow. This blade has a construction which specifically enables the blade to be employed beneath a conventional snow plow. More specifically, the blade of the present invention includes an angularly positioned forward plow surface and a rearward plow surface. These two plow surfaces are interrelated by way of a number of equally spaced reinforcing ribs. Securement means are included to enable the forward plow surface to be removably secured to the bottom edge of a conventional snow plow.

6 Claims, 2 Drawing Sheets

BACK PLOW BLADE CONSTRUCTION

BACKGROUND OF THE INVENTION

1. Field of the Invention

The present invention relates to a back plow blade construction and more particularly pertains to a blade which is adapted to be secured to a conventional snow plow to allow for the collection of materials in both the forward and reverse directions.

2. Description of the Prior Art

The use of back fill blades is known in the prior art. More specifically, back fill blades heretofore devised and utilized for the purpose of utilizing such blades for use in conjunction with trench excavating machines are known to consist basically of familiar, expected, and obvious structural configurations, notwithstanding the myriad of designs encompassed by the crowded prior art which has been developed for the fulfillment of countless objectives and requirements.

The prior art discloses a large number of devices for a blade which is adapted to be secured to a conventional snow plow to allow for the collection of materials in both the forward and reverse directions. By way of example, U.S. Pat. No. 2,899,760 to Armington discloses a multi-purpose bulldozer blade.

U.S. Pat. No. 2,935,802 to Wolfe discloses a multi-function attachment carrier for farm loaders.

U.S. Pat. No. 2,061,585 to Meyer discloses a track clearing implement.

Lastly, U.S. Pat. No. 3,233,350 to Maizahn discloses a quick detachable back fill blade for a trencher.

In this respect, the back plow blade construction according to the present invention substantially departs from the conventional concepts and designs of the prior art, and in doing so provides an apparatus primarily developed for the purpose of a blade which is adapted to be secured to a conventional snow plow to allow for the collection of materials in both the forward and reverse directions.

Therefore, it can be appreciated that there exists a continuing need for a new and improved back plow blade construction which can be used for a blade which is adapted to be secured to a conventional snow plow to allow for the collection of materials in both the forward and reverse directions. In this regard, the present invention substantially fulfills this need.

SUMMARY OF THE INVENTION

In view of the foregoing disadvantages inherent in the known types of back fill blades now present in the prior art, the present invention provides an improved back plow blade construction. As such, the general purpose of the present invention, which will be described subsequently in greater detail, is to provide a new and improved back plow blade construction and methods which have all the advantages of the prior art and none of the disadvantages.

To attain this, the present invention essentially comprises a blade adapted to be secured to the bottom of a conventional snow plow for the purpose of collecting snow in either of two directions of travel, the blade comprising, in combination, an angularly positioned forward plow surface, the forward plow surface having an upper extent and a lower extent, a plurality of securement apertures formed along the length of the upper extent of the forward plow surface; a rearward plow surface having an upper extent and a lower extent, the lower extent of the rearward plow surface being pointed; a plurality of equally spaced trapezoidal-shaped reinforcing rims secured intermediate to the forward plow surface and the rearward plow surface; and a plurality of securement elements equal in number to the plurality of securement apertures, the plurality of securement elements adapted to be removably secured within the corresponding securement apertures to thereby secure the blade to the bottom of a conventional snowplow, the securement elements and apertures being positioned intermediate the reinforcement rims.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved back plow blade construction which has all the advantages of the prior art back fill blades and none of the disadvantages.

It is another object of the present invention to provide a new and improved back plow blade construction which may be easily and efficiently manufactured and marketed.

It is a further object of the present invention to provide a new and improved back plow blade construction which is of a durable and reliable construction.

An even further object of the present invention is to provide a new and improved back plow blade construction which is susceptible of a low cost of manufacture with regard to both materials and labor, and which accordingly is then susceptible of low prices of sale to the consuming public, thereby making such back fill blades economically available to the buying public.

Even still another object of the present invention is to a blade which is adapted to be secured to a conventional snow plow to allow for the collection of materials in both the forward and reverse directions.

Lastly, it is an object of the present invention to provide a blade which can be removably secured to the bottom of a conventional snow plow. The blade enables the operator of the snow plow to collect snow in either the forward or rearward running directions of the snow plow. This blade has a construction which specifically enables the blade to be employed beneath a conventional snow plow. More specifically, the blade of the present invention includes an angularly positioned forward plow surface and a rearward plow surface. These two plow surfaces are interrelated by way of a number of equally spaced reinforcing ribs. Securement means are included to enable the forward plow surface to be removably secured to the bottom edge of a conventional snow plow.

These together with other objects of the invention, along with the various features of novelty which characterize the invention are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
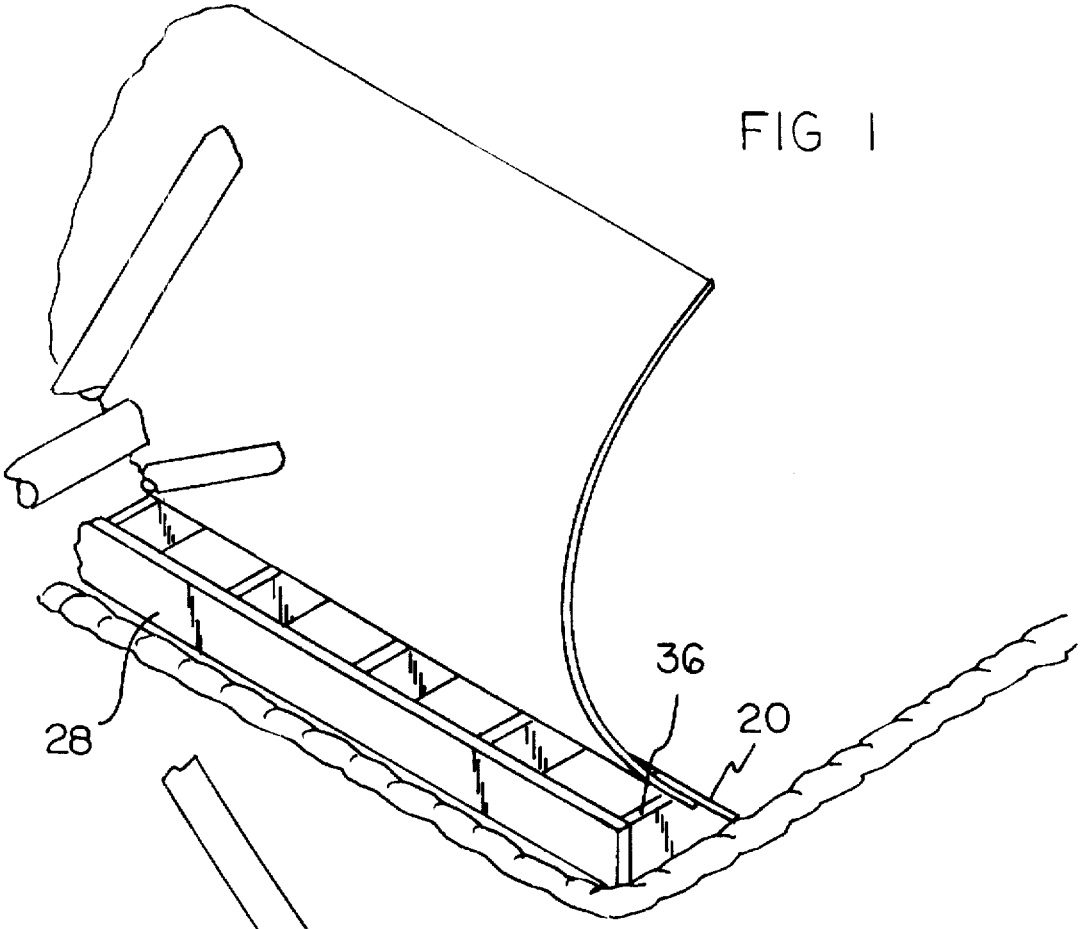
FIG. 1 is a perspective illustration of the blade assembly constructed in accordance with the principles of the present invention.

With reference now to the drawings, and in particular to FIG. 1 thereof, the preferred embodiment of the new and improved back plow blade construction embodying the principles and concepts of the present invention and generally designated by the reference numeral 10 will be described.

The present invention relates to a blade 10 which can be removably secured to the bottom of a conventional snow plow. The blade 10 enables the operator of the snow plow to collect snow in either the forward or rearward running directions of the snow plow. This blade 10 has a construction which specifically enables the blade to be employed beneath a conventional snow plow. More specifically, the blade of the present invention includes an angularly positioned forward plow surface 20 and a rearward plow surface 28. These two plow surfaces are interrelated by way of a number of equally spaced reinforcing ribs 36. Securement means are included to enable the forward plow surface 20 to be removably secured to the bottom edge of a conventional snow plow. The components of the present invention, and the manner in which they interrelate, will be described in greater detail hereinafter.

Figure 2:
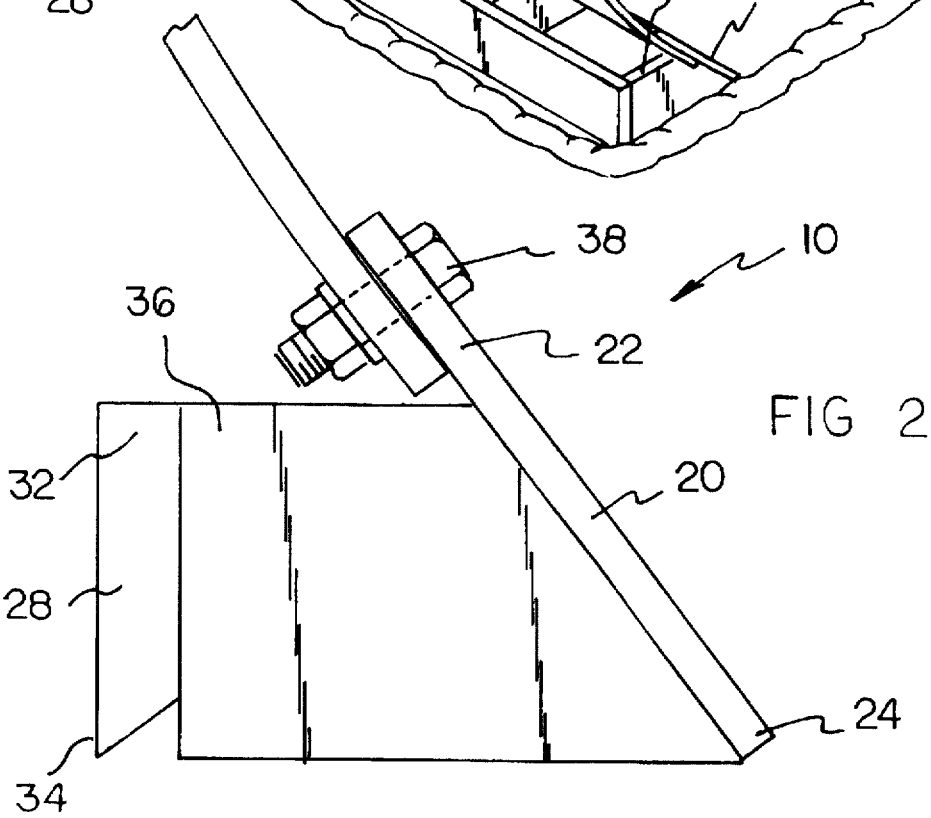
FIG. 2 is an elevational view of the blade assembly in accordance with the present invention.
Figure 4:
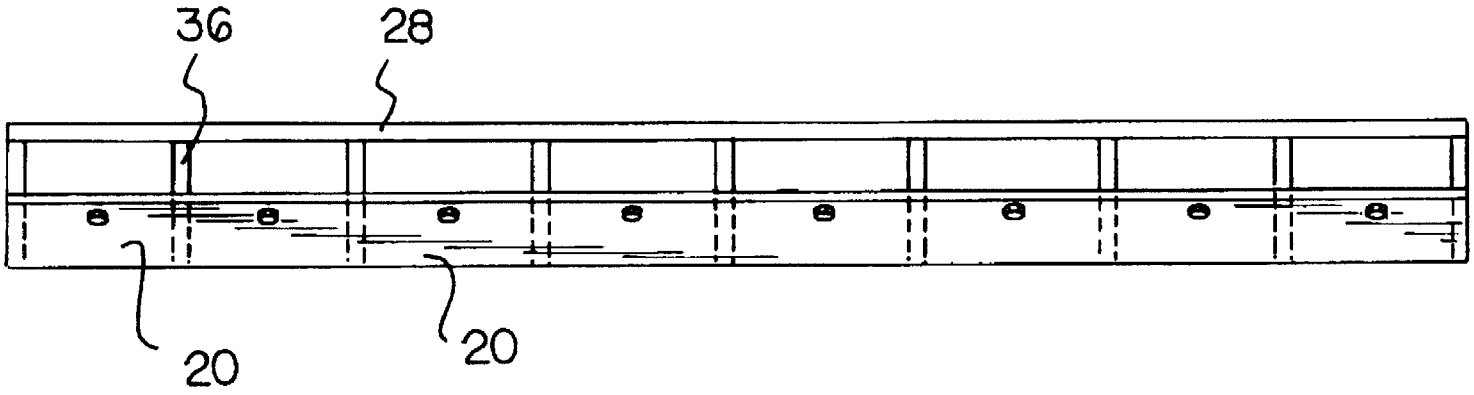
FIG. 4 is a view taken along line 4—4 of FIG. 3.
Figure 3:
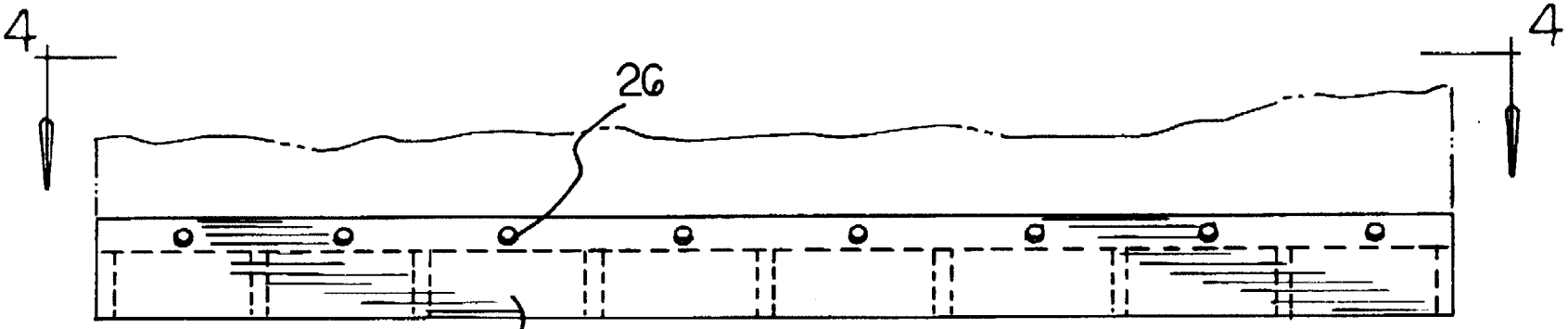
FIG. 3 is a plan view of the blade assembly in accordance with the present invention.

As indicated the blade 10 of the present invention allows the operator of a snow plow to collect snow in either of the two directions of travel. The first component of this blade is the angularly positioned forward plow surface 20. More specifically, the forward plow surface 20 makes an angle of approximately 45 degrees with respect to the horizontal. The inclination of the forward plow surface 20 is best illustrated in FIG. 2. Furthermore, the forward plow surface 20 is defined by an upper extent 22 and a lower extent 24. In order to facilitate the blade assembly to be secured to a snow plow, a plurality of securement apertures 26 are formed along the length of the upper extent 22 of the forward plow surface 20. These apertures 26 are illustrated in FIGS. 3 and 4.

The second major component of the blade assembly is the rearward plow surface 28. As with the forward plow surface, the rearward plow surface 28 is defined by an upper extent 32 and a lower extent 34. In the preferred embodiment the lower extent 34 of the rearward plow surface 28 is pointed. The pointed nature of the rearward plow surface 28 facilitates its use in scraping snow and/or ice. As is evident in reference to FIG. 2, the rearward plow surface 28 has a height which is substantially smaller than the forward plow surface 20. In the preferred embodiment, each of the plow surfaces is constructed from a carbon steel alloy. Furthermore each of the plow surfaces has a length which corresponds to the length of a conventional snow plow. Thus, as is illustrated in FIG. 2, the forward plow surface 20 is angularly related with respect to the rearward plow surface 28.

A plurality of equally spaced reinforcing ribs 36 are utilized in interconnecting the forward and rearward plow surfaces and provide a degree of rigidity to the entire blade assembly. In the preferred embodiment, each of these reinforcing ribs 36 is trapezoidal in shape with the forward surface of each rib accommodating the inclination of the forward plow surface 20. The trapezoidal shape of each of the ribs can be seen in reference to FIG. 2. The securement between the reinforcing ribs and the plow surfaces can be accomplished through welding or other securement means conventional in the art.

A securement means is employed to removably attach the blade 20 to the bottom of a conventional snow plow. In the preferred embodiment this securement means takes the form of a plurality of securement elements 38 which are equal in number to the plurality of securement apertures. Furthermore, in the preferred embodiment, there are eight such securement elements and a corresponding number of securement apertures. The plurality of securement elements 38 are adapted to be removably secured within the corresponding securement apertures 26 to thereby secure the blade to the bottom of a conventional snow plow. The securement element can take the form of a nut and bolt assembly. Additionally, in an effort to distribute the forces delivered to the blade assembly to both the reinforcing ribs and to the securement means, the reinforcing ribs and securement means are staggered with respect to one another. In other words, the securement elements and corresponding apertures are positioned intermediate the reinforcing ribs. The relationship between the securement means and the reinforcement ribs is most clearly seen in reference to FIGS. 3 and 4.

In operation the user of a conventional snow plow can secure the blade assembly of the present invention to the bottom edge of the snow plow. This essentially places the blade assembly of the present invention fully beneath the snow plow with the forward plow surface being generally aligned with the bottom edge of the snow plow and the reinforcing ribs and rearward plow surface extending towards the back surface of the snow plow. The relationship between the conventional snow plow and the blade of the present invention is most clearly seen in reference to FIG. 1. Thus, when attached, the user can employ the snow plow in the forward direction as is conventional. Here, the forward plow surface acts to collect snow and/or any other materials to be collected. However, with the blade construction of the present invention the user of the snow plow can also collect materials while moving in reverse. While the operator is moving in reverse the rearward plow surface acts to collect the materials.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A blade adapted to be secured to the bottom of a conventional snow plow for the purpose of collecting snow in either of two directions of travel, the blade comprising, in combination:

an angularly positioned forward plow surface, the forward plow surface having an upper extent and a lower extent, a plurality of securement apertures formed along the length of the upper extent of the forward plow surface;

a rearward plow surface having an upper extent and a lower extent, the lower extent of the rearward plow surface being pointed;

a plurality of equally spaced trapezoidal-shaped reinforcing ribs secured intermediate to the forward plow surface and the rearward plow surface the ribs being equally spaced along the entire length of the forward and rearward plow surfaces;

a plurality of securement elements equal in number to the plurality of securement apertures, the plurality of securement elements adapted to be removably secured within the corresponding securement apertures to thereby secure the blade to the bottom of a conventional snowplow, the securement elements and apertures each being positioned intermediate adjacent reinforcement ribs.

2. A blade adapted to be secured to the bottom of a conventional snow plow for the purpose of collecting snow in either of two directions of travel, the blade comprising:

a forward plow surface, the forward plow surface having an upper extent and a lower extent;

a rearward plow surface having an upper extent and a lower extent;

a plurality of equally spaced reinforcing ribs secured intermediate to the forward plow surface and the rearward plow surface the ribs being equally spaced along the entire length of the forward and rearward plow surfaces;

a plurality of securing means to removably attach the blade to the bottom of a conventional snow plow each of the reinforcing ribs being positioned intermediate adjacent securing means.

3. The blade as described in claim 2 wherein the forward plow surface is angularly related with respect to the rearward plow surface.

4. The device as described in claim 2 wherein each of the equally spaced reinforcing ribs is trapezoidal in shape.

5. The blade as described in claim 2 wherein:

a plurality of securement apertures are formed along the length of the upper extent of the forward plow surface;

and the securement means comprises a plurality of securement elements equal in number to the plurality of securement apertures, the plurality of securement elements adapted to be removably secured within the corresponding securement apertures to thereby secure the blade to the bottom of a conventional snow plow.

6. The blade as described in claim 2 wherein:

the lower extent of the rearward plow surface is pointed.

* * * * *